United States Patent [19]

Sasao

[11] Patent Number: 4,671,391

[45] Date of Patent: Jun. 9, 1987

[54] MOVING DISTANCE DETECTOR FOR AN ELEVATOR

[75] Inventor: Isao Sasao, Inazawa City, Japan

[73] Assignee: Mitsubishi Denki Kabushiki Kaisha, Tokyo, Japan

[21] Appl. No.: 864,485

[22] Filed: May 19, 1986

[30] Foreign Application Priority Data

May 31, 1985 [JP] Japan ..... 60-117923

[51] Int. Cl.[4] ..... B66B 3/02

[52] U.S. Cl. ..... 187/134

[58] Field of Search ..... 187/29; 340/19, 21

[56] References Cited

U.S. PATENT DOCUMENTS

| | | | |
|---|---|---|---|
| 4,218,671 | 8/1980 | Lewis | 340/21 |
| 4,341,287 | 7/1982 | Kuzunuki et al. | 187/29 R |
| 4,518,062 | 5/1985 | Makinen et al. | 187/29 R |
| 4,624,005 | 11/1986 | Tachino | 187/294 X |

OTHER PUBLICATIONS

"Parallel Type Transmission Circuit:, Transistor Technique Review, pp. 220–221, Jun. 1979.

"Interphase IC–Operation and Application for Line Driver and Receiver" Texas Instruments, Jan. 1983.

*Primary Examiner*—William M. Shoop, Jr.

*Assistant Examiner*—W. E. Duncanson, Jr.

*Attorney, Agent, or Firm*—Leydig, Voit & Mayer

[57] ABSTRACT

A moving distance detector for an elevator including an encoder pulse receiver having a differential amplifier for receiving input signal pulses generated upon movement of an elevator cage and transmitted on first and second signal transmission lines. Resistors are respectively connected between the first signal transmission line and a first input terminal of the differential amplifier and between the second signal transmission line and a second input terminal thereof to provide a difference between the low and high voltage signals at the first and second input terminals of the differential amplifier. Since the biasing voltage of a signal provided at one of the input terminals of the differential amplifier when the corresponding transmission line is interrupted is set to be sufficiently different from the high or low voltage level of the signal at the other input terminal, an output representing a fault or unstable state in the balancing transmission lines is readily produced. The elevator is prevented from being erroneously controlled to improve the accuracy of the moving distance detector.

6 Claims, 5 Drawing Figures

MOVING DISTANCE DETECTOR FOR AN ELEVATOR

BACKGROUND OF THE INVENTION

The present invention relates to a moving distance detector in an elevator and, more particularly, to improvements in an encoder pulse receiver in a device for detecting the moving distance of an elevator cage by an encoder.

A counter for counting a pulse signal output from a rotary encoder has been used in general for digitally detecting the moving distance of an elevator cage. FIG. 3 shows an example of a method of measuring the moving distance of an elevator cage using the counter. In FIG. 3, reference numeral 1 denotes an electric motor, numeral 2 denotes a drive sheave of a winch driven by the motor 1, numeral 3 denotes a main cable engaged with the sheave 2, and a cage 4 and a balance weight 5 are engaged with both ends of the main cable 3.

Reference numeral 6 denotes a rotary encoder (hereinbelow referred to as "an encoder") for outputting a pulse signal in response to the rotation of the motor 1. This pulse signal is input through a transmission line 6A to an encoder pulse receiver 7, and then fed to a counter 8 which counts the signal pulses to detect the moving distance of the cage 4 on the basis of the counted value.

The internal configuration of the encoder 6 and the encoder pulse receiver 7 described above are shown in FIG. 4. In FIG. 4, the encoder 6 comprises a disk 61 formed with a plurality of light transmitting slits radially formed along the circumferential direction thereof, so as to rotate as the motor 1 rotates, a photoelectric device 62 for detecting the light passed through the slits to transmit a pulse detection signal responsive to the rotation of the motor 1, and a differential driver 63 for transmitting the detection signals as differential pulse signals $V_A$, $V_B$.

A differential amplifier 71 forms an encoder pulse receiver 7, receives the differential pulse signal and outputs a pulse signal $V_C$ responsive to the pulse detection signal, and terminating resistors 72 and 73 for biasing input terminals $A_1$ and $B_1$ to H and L levels, respectively, when no signal is input are respectively provided between the first input terminal $A_1$ of the differential amplifier 71 and a power source V, and between the second input terminal $B_1$ and ground (or a negative power source). Reference character 6A denotes a signal transmission line formed of two wires of signal transmission lines **6*a* and 6*b***.

The operation of the conventional moving distance detector of an elevator constructed as described above will be described with reference to FIGS. 1 to 4 together with FIG. 5. FIG. 5 is a waveform diagram of pulse signals presented at the input terminals $A_1$, $B_1$ and the output terminal $C_1$ of the encoder pulse receiver.

A pulse detection signal output from the photoelectric device 62 in response to the rotation of the motor 1 is converted by the differential driver 63 to the differential pulse signals $V_A$, $V_B$ having relative logic levels (H and L levels), and then input from output terminals $A_0$, $B_0$ through the signal transmission lines **6*a* and 6*b* to the input terminals $A_1$ and $B_1$ of the differential amplifier 71 of the encoder pulse receiver 7**.

Since the logic levels (H or L) of the differential pulse signals $V_A$ and $V_B$ input from the input terminals $A_1$ and $B_1$ are opposite, the differential receiver 71 amplifier the signals as differential signals and outputs a pulse signal $V_C$ responsive to the difference. As a result, even if a noise is induced from the signal transmission line 6A to the differential pulse signals $V_A$ and $V_B$ while the differential pulse signals $V_A$, $V_B$ are transmitting from the encoder side through the signal transmission line 6A, the noise is removed from the differential signals $V_A$, $V_B$ because the noise is input to the differential amplifier 71 together with the differential pulse signals $V_A$, $V_B$ as the same phase components, and the pulse signal $V_C$ of the output is not affected by the noise. Further, when one of the differential pulse signals $V_A$, $V_B$ is not transmitted due to the disconnection of one of the signal transmission lines **6*a* or 6*b*, the input terminals $A_1$ or $B_1$ of the differential amplifier 71 connected to the disconnected signal line is biased by the terminating resistor 72 or 73 to the H or L level potential of the differential pulse signal. The differential amplifier 71 inputs the biased potential and one differential pulse signal transmitted through the normal signal line, and outputs a pulse signal $V_C$. The pulse signal $V_C$ is counted by the counter 8 which detects the moving distance of the cage 4** on the basis of the counted value.

Since the conventional moving distance detector of the elevator using a balancing transmission system is constructed as described above, when one signal is not transmitted due to the disconnection of the signal transmission lines **6*a*, 6*b* or improper connection of the connector connecting the signal transmission lines 6*a*, 6*b* to the encoder 6 or the encoder pulse receiver 7, such as, for example, when the signal transmission line 6*b* is disconnected, the input terminal $B_1$ of the differential amplifier 71 is biased by the terminating resistor 73 substantially to L level $V_L$, and when the signal level of the input terminal $A_1$ becomes the L level $V_L$, the signals of the both input terminals substantially coincide. However, since the signal level of the output terminal $C_1$ is determined by only a slight difference of the signal level between the input terminals $A_1$ and $B_1$, the pulse signal output from the differential amplifier 71 is erroneously generated and becomes very unstable. As a result, more than a required predetermined number of pulses are generated, or less pulses are generated. Consequently, there arises various problems that the value of the pulses counted by the counter 8 does not coincide with the moving distance of the cage 4**, the elevator cannot be correctly controlled, and that the problem cannot be readily discovered.

SUMMARY OF THE INVENTION

The present invention has been made to eliminate the above-described problems and has for its object to provide a moving distance detector for an elevator which can prevent the elevator from being controlled on the basis of unstable pulses by interrupting the output of the output pulse signal from the differential amplifier when one of differential pulse signals is not transmitted due to the disconnection of the signal transmission line or the improper connection of the connector, and which can readily discover trouble in the control function of the moving elevator cage due to the improper signal transmission line.

More particularly, the moving distance detector for an elevator according to the present invention comprises resistors respectively connected between the first signal transmission line and the first input terminal of a differential amplifier, and between the second signal transmission line and the second input terminal of the differential amplifier to provide a difference in the signal levels input to the first and second input terminals of the differential amplifier, thereby allowing the differential receiver to amplifier a signal having a level difference.

In the differential receiver for forming the encoder pulse receiver in the present invention, since the voltage level of the biasing voltage of the input terminal in which one of the differential pulse signals is interrupted has a sufficient level difference from H or L level of the pulse signal input to the other input terminal, it stops the pulse outputting of the unstable state and outputs the output signal of a constant level. Thus, it can prevent the elevator from being unstably controlled and can readily discover the problem early.

DESCRIPTION OF THE PREFERRED EMBODIMENTS

Figure 2:
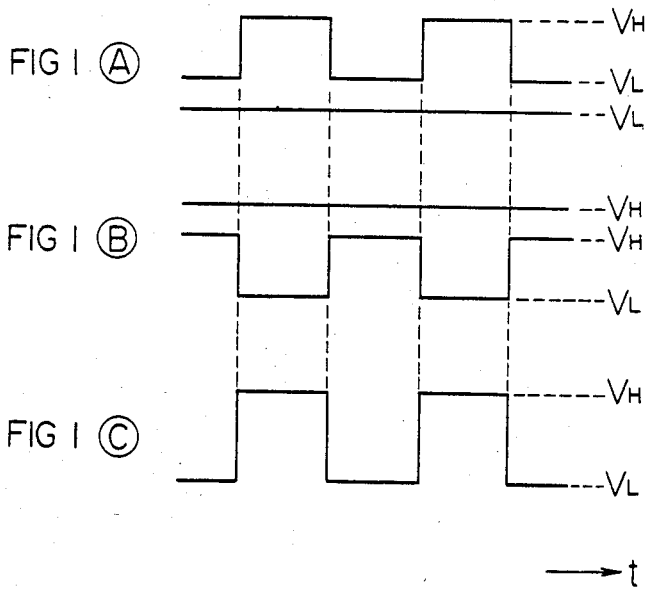
FIG. 2 is a waveform diagram for explaining the operation of the detector in FIG. 1.
Figure 3:
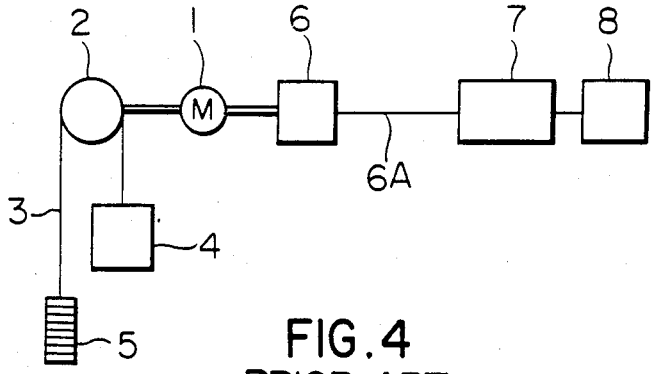
FIG. 3 PRIOR ART
FIG. 3 is a block diagram of an example of a method of detecting the distance of an elevator.
Figure 4:
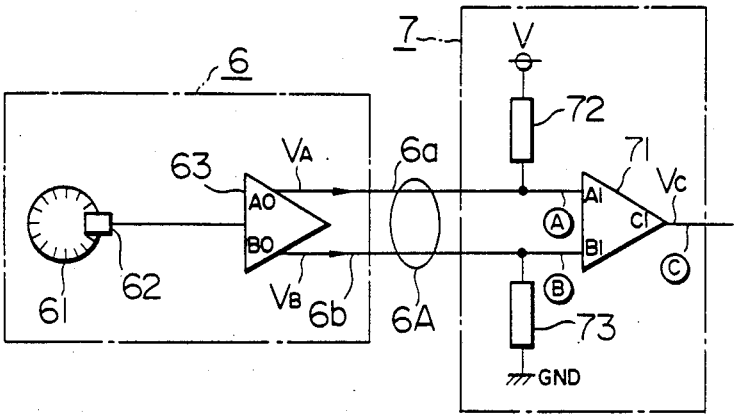
FIG. 4 PRIOR ART
FIG. 4 is a circuit diagram showing the conventional moving distance detector of an elevator.
Figure 5:
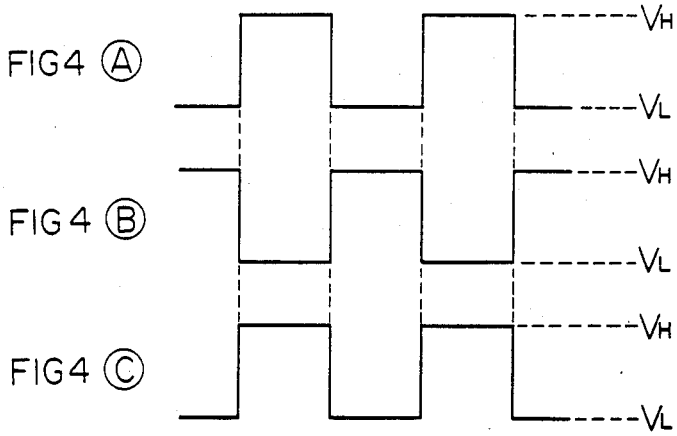
FIG. 5 PRIOR ART
FIG. 5 is a waveform diagram for explaining the operation of the detector in FIG. 4.

An embodiment of the present invention will be described below in conjunction with FIGS. 1 and 2. The same reference numeral as those in FIGS. 3 to 5 designate the same or equivalent reference numerals, and the description will be omitted.

Figure 1:
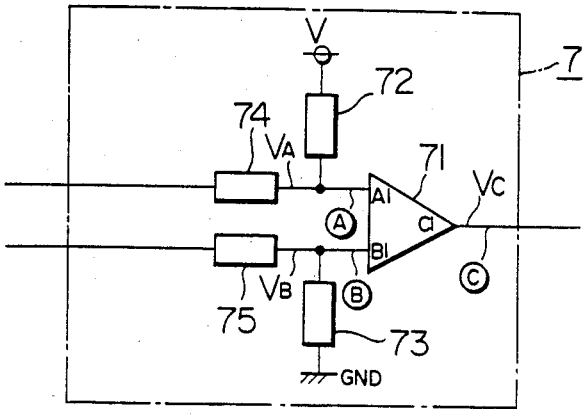
FIG. 1 is a circuit diagram showing an embodiment of a moving distance detector for an elevator according to the present invention.

In FIG. 1, reference numerals 74 and 75 designate resistors. Assuming that pulse signals of the waveforms shown by A and B in FIG. 5, i.e., signals having levels $V_H$ and $V_L$ are applied to the input of the encoder pulse receiver 7, then, the pulse signal at the first and second input terminals $A_1$ and $B_1$ of the differential amplifier 71 are, as shown by A and B in FIG. 2, such that the signal $V_A$ of the first input terminal $A_1$ has signal levels of $V_H$ and $V_L'$ via the resistors 72 and 74 and the signal $V_B$ of the second input terminal $B_1$ has signal levels of $V_H'$ and $V_L$ via the resistors 73 and 75.

The values of the resistors 74 and 75 are so selected that the relationship of $V_H > V_H' > V_L' > V_L$ resides between the signal levels. Further, the relationships of the power source V, the earth potential and the signal levels $V_H$, $V_L$ are such that $V \simeq V_H$ and the earth potential $\simeq V_L$.

Since constructed as described above, when one signal is interrupted due to the improper connection of the signal transmission line 6*a* or 6*b*, or the connector, such as, for example, when the signal transmission line 6*b* is interrupted, the signal level $V_B$ of the input terminal $B_1$ of the differential amplifier 71 is biased by the resistor 73 to the L level to always become $V_B = V_L$, and the relationship between the signal level $V_A$ and the input terminal $A_1$ always becomes $V_A > V_B$. Therefore, the output of the differential amplifier 71 always becomes $V_H$. When the transmission line 6*a* is interrupted, the input terminal $A_1$ becomes $V_A = V_H$ via the resistor 72 and the relationship between the $V_A$ and the $V_B$ become $V_A > V_B$. Therefore, the output of the differential amplifier 71 similarly always becomes $V_H$, and the amplifier 71 outputs a H level output. Consequently, when one of the balancing transmission output is interrupted, a pulse output from the receiver 7 is stopped. Thus, the trouble of the moving distance detector can be quickly discovered by a safety circuit (not shown) of the elevator system to prevent the elevator from being controlled during a malfunction state.

It is noted that the resistor 75 may be omitted when the internal resistance (not shown) of the differential driver 63 of the encoder 6 is utilized. The foregoing description has been done with respect to the case that the present invention is applied to the elevator. However, the present invention may also be applied to other system within the spirit and scope of the present invention.

According to the present invention as described above, the output pulse from the encoder pulse receiver can be effectively interrupted when one signal is interrupted by providing a level difference between two input signals input to the differential amplifier of a balancing transmission type. Therefore, it can prevent the elevator from being controlled in the state that unstable pulses are output and can readily discover the trouble to provide a safe system.

What is claimed is:

1. A moving distance detector for an elevator comprising:

an encoder connected to the elevator and providing an output signal pulse whenever an elevator cage moves a unit distance, an encoder pulse receiver connected to receive the output signal pulses from said encoder, a counter counting the output signal pulses of said encoder to determine the moving distance of the elevator cage, and a balancing transmission system including first and second signal transmission lines providing a signal path between said encoder and said encoder pulse receiver, said encoder pulse receiver including a differential amplifier having first and second input terminals respectively connected to positive and negative power sources through a pair of terminating resistors, a first resistor connected between the first signal transmission line and the first input terminal of said differential amplifier to set a low voltage signal at the first input terminal to an intermediate value between low and high voltage levels of a signal at the second input terminal, and a second resistor connected between the second signal transmission line and the second input terminal of said differential amplifier to set a high voltage signal at the second input terminal to an intermediate value between low and high voltage levels of a signal at the first input terminal, whereby a sufficient level difference between the low and high voltage signals at the first and second input terminals is provided to prevent the elevator from being erroneously controlled when the output signal pulses from said encoder are unstable.

2. A moving distance detector for an elevator as set forth in claim 1 wherein the low voltage input signal at the first input terminal of said differential amplifier is set to a value higher than the low voltage level of the signal at the second input terminal of said differential amplifier.

3. A moving distance detector for an elevator as set forth in claim 2 wherein when said first signal transmission line is interrupted, the signal at the first input terminal is held at a voltage level higher than the high voltage level of the signal at the second input terminal.

4. A moving distance detector for an elevator as set forth in claim 1 wherein the high voltage signal at the second input terminal of said differential amplifier is set to a value lower than the high voltage level of the signal at the first input terminal there of.

5. A moving distance detector for an elevator as set forth in claim 4 wherein when said second signal transmission line is interrupted, the signal at the second input terminal is held at a voltage level lower than the low voltage level of the signal at the first input terminal.

6. A moving distance detector for an elevator as set forth in claim 1 wherein when at least one of said first and second signal transmission lines in interrupted, said encoder pulse receiver produces a constant high level output representing a fault in the balancing transmission system.

* * * * *